United States Patent [19]

Sagasta

[11] 4,099,386

[45] Jul. 11, 1978

[54] ARRANGEMENTS USED FOR SHORING EXCAVATIONS IN THE GROUND

[76] Inventor: D. Lucio Arana Sagasta, Coso, 34, Zaragoza, Spain

[21] Appl. No.: 715,842

[22] Filed: Aug. 19, 1976

[30] Foreign Application Priority Data

Oct. 8, 1975 [ES] Spain ..... 441.608

[51] Int. Cl.[2] ..... E01G 5/00

[52] U.S. Cl. ..... 61/45 R; 52/671; 52/674

[58] Field of Search ..... 61/45 R, 84, 85; 52/674, 675, 671

[56] References Cited

U.S. PATENT DOCUMENTS

| | | | |
|---|---|---|---|
| 447,085 | 2/1891 | Sagendorph | 52/674 |
| 514,313 | 2/1894 | Eckstein | 52/674 |
| 1,726,696 | 9/1929 | Dean | 52/674 |
| 3,224,203 | 12/1965 | Brannfors et al. | 61/45 |
| 3,855,801 | 12/1974 | Bernold | 61/45 R |

*Primary Examiner*—Jacob Shapiro

*Attorney, Agent, or Firm*—Eyre, Mann, Lucas & Just

[57] ABSTRACT

A shoring system provides trapezoidal pockets in modular plating units. The junction of planes in the trapezoids provides mechanical strength and deformation sites at which deformation can be seen.

1 Claim, 6 Drawing Figures

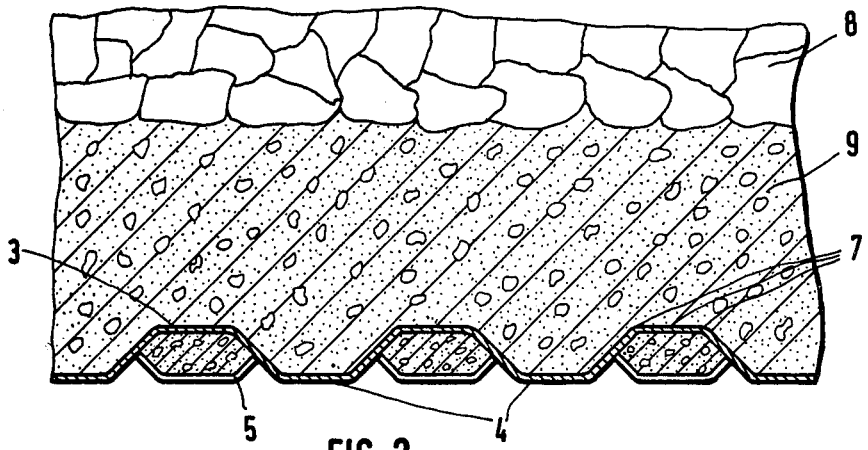
FIG. 2
FIG. 5
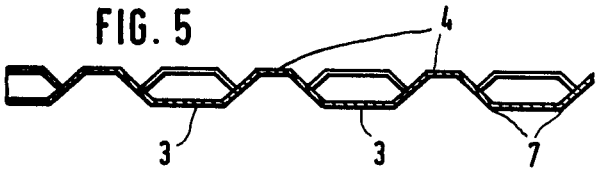
FIG. 6
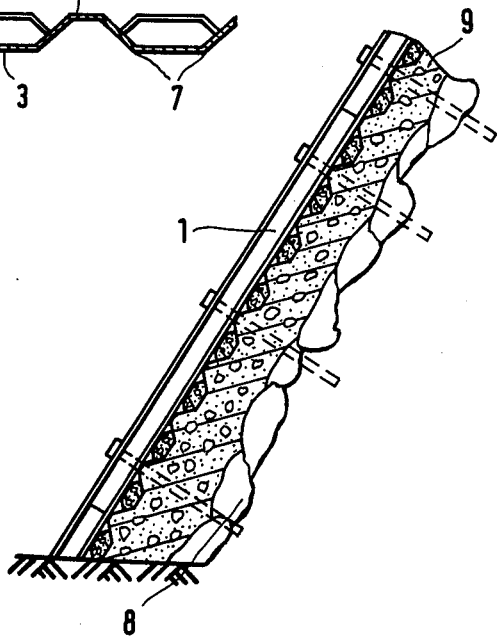
FIG. 4
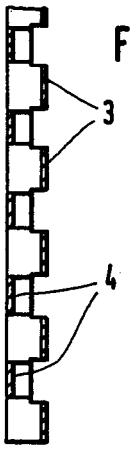

ARRANGEMENTS USED FOR SHORING EXCAVATIONS IN THE GROUND

FIELD OF THE INVENTION

Whenever any kind of excavation is carried out, either as an open pit, or underground, as in the case of a tunnel, the time comes after a certain stage has been reached in the work, that there is an alteration in the state of tension, commonly termed a subsidance, which takes place around the face being worked and where dynamiting is carried out; this being due to the earth previously supporting the sides (and the roof if it is a tunnel) having been removed in the course of the job being undertaken. This situation may come about either gradually, or it may arise suddenly, due to the effects of blasting.

Unfortunately these considerations must always be looked at from the theoretical point of view only, and they have no application in actual practice, since the characteristics of the ground being excavated are liable to vary so much that they cannot be used as a reliable means at all on which to base safety precautions. On the other hand, modern civil engineering practice is such that work is required to be carried out with such expediency and efficiency that this situation involving subsidence of the soil must be considered of paramount importance in order to avoid personal and material accidents and injuries which could occur if the subsidence was to give rise to a landslide.

DESCRIPTION OF THE PRIOR ART

The traditional practice employed to alleviate the effects of subsidence entails the use of shoring, comprising a series of frame having the same shape as the inside of the excavation, these being what are known as trusses when used in tunnels; and other members called longitudinals, which are placed perpendicularly to the trusses, thus lining the inside of the tunnel with a conventional shoring arrangement.

This type of shoring has the disadvantage of being extremely laborious to erect, and it inevitably makes the job much longer than it would otherwise need to be, were it not for the safely considerations involved to prevent accidents.

SUMMARY OF THE INVENTION

The embodiment proposed under the present invention, allows considerable improvements to be made to shoring arrangements in excavation work, enabling erection to be undertaken very rapidly indeed, and also counteracting the effects of subsidence to an acceptable degree; while at the same time it even detects serious cases of subsidence, which because of their nature, may require other arrangements to be made to counteract them and remove danger.

DESCRIPTION OF THE DRAWINGS

Embodiments of the invention will now be described by way of illustration with reference to the accompanying drawings showing a schematic arrangement of the application. Such schematic arrangement is in no way to be construed as imposing any limitations on the embodiment, and it may therefore be subject to those slight alterations which do not affect its essential features.

FIG. 2 is an enlarged detail view of the section marked 10 in FIG. 1.

FIG. 4 is a sectional view on plane 11 — 11 shown in FIG. 3,

FIG. 5 is a sectional view on plane 12 — 12 shown in FIG. 3.

FIG. 6 illustrates the application of the invention as shoring in an ordinary open pit.

Figure 1:
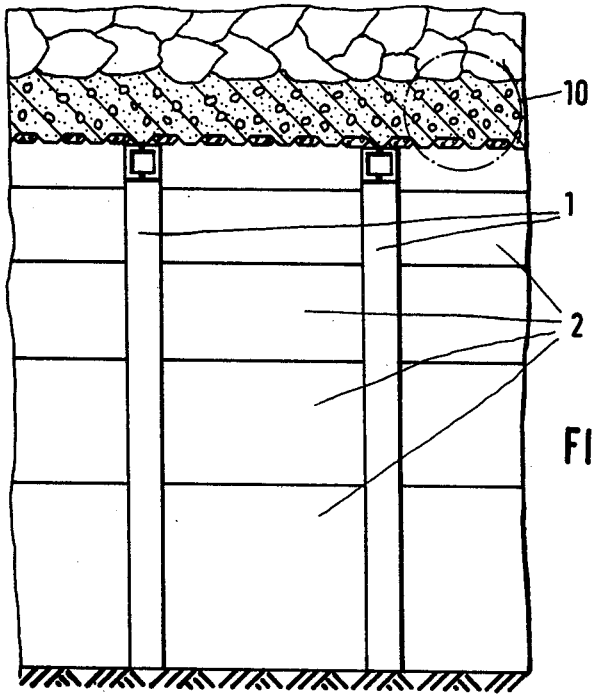
Referring to FIG. 1, this shows a longitudinal cross-sectional view of a tunnel shored in accordance with the invention.
Figure 3:
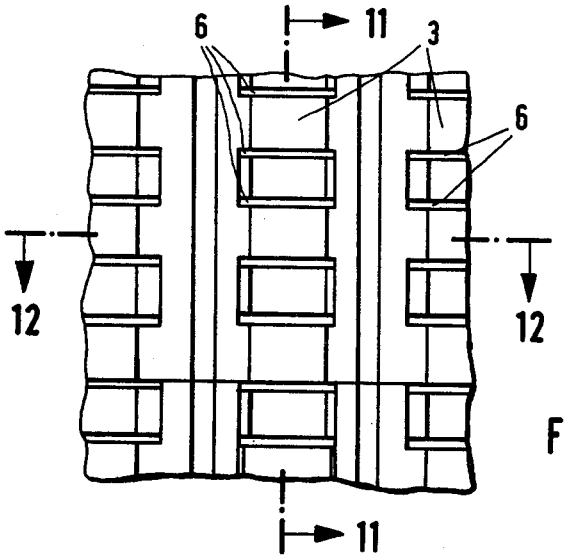
FIG. 3 is a plan view of part of the modular plating units.

The following legend is used in the accompanying drawings to identify the different parts of the embodiment and its location as listed below:

1 — Frames or trusses.
2 — Modular plating units.
3 — Convex trapeziforms.
4 — Joining segments.
5 — Concave trapeziforms.
6 — Windows.
7 — Outer edges.
8 — Soil or rock.
9 — Concrete.
10 — Section.
11 — Section.
12 — Section.

DESCRIPTION OF THE PREFERRED EMBODIMENTS

In accordance with the improvements allowed for with the embodiment, and which are especially suited for shoring in excavations where the work needs to be undertaken with the utmost care, or where it is required to compensate for, or measure subsidence taking place in the vicinity of the face being worked, the procedure adopted is to place frames or trusses 1 in the hollow dug out, these having a shape similar to the section of the hollow, and it is on these trusses 1 where modular plating units 2 are supported, these being fabricated from steel pressings with a special design insofar that they have polygonal shaped leading edges, each made up from trapeziforms with alternate sides parallel to one another 3 and 5, being open at the wider end and bridged at the narrow end by means of segments 4 arranged alternately as concaves and convexes on each successive pair of units, and having outer edges 7 in their section as shown in the drawings. The space between modular plating units 2 and the soil 8 is filled with concrete 9, placed in position by any conventional means, in such a way that modular plating units 2 become attached to the inside surface of the excavation.

In this way, subsidence of the ground is prevented to a very large degree, since all fresh surfaces uncovered 8 in the course of digging, are immediately held secure by the inner supporting lining. The chief advantage derived from these improvements comes about as the result of the plating units having a polygonal shaped surface, which is considerably better than other means commonly used for shoring, because their mechanical strength is such as to enable them to withstand more satisfactorily the type of stressing brought about by forces imposed from the overlying soil. Moreover, edges 7 of the channels are designed so as to comprise lines where strains are concentrated, and can act as flexing points without stressing or affecting the rigid plates themselves, thus allowing the plating to adapt itself to the shape of the inside of the excavation. Such adaption is achieved because of the flexibility of the steel comprising the plate subjected to stressing along the length of the flexing edges as described, so that any slight local excess pressure is absorbed.

There is another extremely important effect which is achieved with this shoring arrangement having beams with flexing edges, and which is that any dangerous overstressing brought about from pressure in the surrounding soil can be quickly detected, because the edges of the beams will become noticeably deformed in way of the area in question. Hence, such deformations can be used to pin point places where subsidence has or is taking place, and which may require special reinforcement.

When the beams described in this invention are used as permanent shuttering for lining tunnels or open pits with concrete, the fact that the faces are parallel to the longitudinal centre line of the beams, and therefore to the face of the excavation, means that they contribute considerably to reinforcing the concrete. When applied to tunnels, the plates can be fabricated with a suitable curvature to allow them to adapt themselves to the cross-section as required.

The remaining faces, oblique to those just mentioned, serve the purpose of absorbing shear stresses set up in the concave face of the tunnel or pit at the periphery of the lining, thus preventing cracks from beginning; these being something which usually extend towards the inside of the hollow when the lining is made of concrete, and they are visible in any tunnel lined with this kind of material.

In order to obtain an increased degree of strength binding between plate unit 2 and the concrete, the former may have a layer of gunnite or concrete containing metal or glass fibre, extended over its surface to a suitable thickness. Such layer, in addition to improving strength performance, will help to protect the plate against corrosion.

A further noteworthy improvement achieved with the present invention concerns the need for all shoring to be strictly checked under difficult conditions, and frequently using only semi-skilled labour to do so. This means that any improvement allowing the erection of the shoring to be done more quickly and with increased simplicity is bound to be an advantage. The advantage achieved in this particular case is that as plates 2 are fabricated steel pressings, they are sufficiently rigid to allow the actual thickness of the material to be reduced without prejudicing strength, so that they are lighter in weight and can be more readily handled than members used in conventional shoring arrangements. More particularly, the advantage is derived from the fact that between each pair of adjoining and therefore opposing trapeziforms 3 and 5, windows 6 are arranged in the form of gaps which make one of the trapeziforms narrower than the other, so that the width of convex trapeziform 3 is greater than that of concave trapeziform 5. Hence, when two modular plate units are overlapped upon being assembled together, such assembly can be easily carried out, since these windows 6 allow play and tolerance to take up any deformation there may have been in the plates either during manufacture, storage or handling. Hence, erection can be smoothly undertaken without difficulties, thus contributing appreciably to the rapidity with which it can be completed.

The simplest way of erecting the modular plate units 2 to make a shoring, is to place the frames or trusses 1 in position first, these being such that their outside edge is about the same shape as the cross-section of the excavation. Modular plate units 2 are then arranged on these trusses 1, and as work on erection of the shuttering progresses, the space between the shoring and the soil 8 is filled with concrete, using either a pump of the type specially designed for this purpose, or any other conventional means normally employed in accordance with this kind of civil engineering technology. Correct size grading of the aggregate in the concrete, a suitably dry mixture to afford proper consistency of the mix, and careful filling of the shuttering, with particular care being paid to proper use of the vibrating rod to ensure this, are all important requirements to be borne in mind to prevent the mix from flowing out through the gaps in the polygonal shaped plates used to make up the shuttering.

Obviously the use of ordinary of oblique reinforcing members, should these be necessary to take up any considerable shear stresses which may arise, or the use of side shuttering, front shuttering for lining tunnels in the usual manner or for filling with concrete back up from the end of the tunnel, and any other technique among those which are traditionally used in this branch of civil engineering are all perfectly applicable in this invention, because in addition to deriving from each of their own peculiar and proven advantages, they will be improved to the extent of the embodiments described herein.

When plates 2 are assembled with others, overlapping is perfectly well achieved through contact between the faces lying parallel to one another, together with that between the protruding edges and the oblique surfaces, all in such a way that the fit allows no freedom or looseness, and there is an efficient coupling between the members.

The distance between trusses 1 will obviously depend on the characteristics of the ground to be shored, although in most cases this is roughly 1 meter.

What I claim is:

1. In a tunnel lining and excavation shoring system of the type having a plurality of substantially parallel spaced-apart trusses spaced from and substantially parallel to the surface to be shored, and metal plating unit attached to and spanning the spaces between said trusses, the space between said plating unit and the surface to be shored being adapted to later filling with concrete, the improvement of a modular plating unit comprising:

(a) said plating unit being fabricated of pressed steel;
(b) said plating unit having parallel trapezoidal longitudinal channels therein;
(c) a row of alternating convex and concave trapezoidal shapes between each pair of parallel trapezoidal longitudinal channels, the apices of said convex and concave trapezoidal shapes being parallel and being located in spaced-apart imaginary planes;
(d) the junction of the walls and apices of said trapezoidal longitudinal channels and said alternating convex and concave trapezoidal shapes being straight and comprising lines for action as flexing points;
(e) windows between adjacent concave and convex trapezoidal shapes; and
(f) said windows reducing the length of one of said concave and convex trapezoidal shapes.

* * * * *